US010267041B1

(12) United States Patent
Cho et al.

(10) Patent No.: US 10,267,041 B1
(45) Date of Patent: Apr. 23, 2019

(54) ANCHORING WEDGE WITH SEPARABLE BOLT AND METHOD OF ANCHORING TENDON USING THE SAME

(71) Applicant: KOREA INSTITUTE OF CIVIL ENGINEERING AND BUILDING TECHNOLOGY, Gyeonggi-do (KR)

(72) Inventors: Bum Yeon Cho, Seoul (KR); Heung Youl Kim, Seoul (KR)

(73) Assignee: KOREA INSTITUTE OF CIVIL ENGINEERING AND BUILDING TECHNOLOGY, Gyeonggi-do (KR)

( * ) Notice: Subject to any disclaimer, the term of this patent is extended or adjusted under 35 U.S.C. 154(b) by 0 days.

(21) Appl. No.: 15/851,707

(22) Filed: Dec. 21, 2017

(30) Foreign Application Priority Data

Oct. 16, 2017 (KR) ..... 10-2017-0133805

(51) Int. Cl.
*E04C 5/12* (2006.01)

(52) U.S. Cl.
CPC ..... *E04C 5/122* (2013.01); *E04C 5/12* (2013.01)

(58) Field of Classification Search
CPC ..... E04C 5/12; E04C 5/122
See application file for complete search history.

(56) References Cited

U.S. PATENT DOCUMENTS

| | | | | |
|---|---|---|---|---|
| 2,887,130 | A * | 5/1959 | Kell | B28B 21/62 138/153 |
| 5,028,188 | A | 7/1991 | Prince | |
| 8,756,885 | B1 * | 6/2014 | Mathews | E04C 5/122 403/369 |
| 9,062,457 | B2 * | 6/2015 | Gilling | E04C 5/165 |
| 9,091,064 | B1 * | 7/2015 | Dahl | E04C 5/122 |
| 9,097,014 | B1 * | 8/2015 | Sorkin | E04C 5/122 |

FOREIGN PATENT DOCUMENTS

| | | |
|---|---|---|
| KR | 100725207 | 6/2007 |
| KR | 101645007 | 8/2016 |

* cited by examiner

*Primary Examiner* — Andrew J Triggs
(74) *Attorney, Agent, or Firm* — JCIPRNET

(57) ABSTRACT

An anchoring wedge with a separable bolt for a simple separation of the anchoring wedge from an anchoring device surrounding a tendon using the separable bolt through efficient adjustment of tensile force and a method of anchoring a tendon using the same are provided.

10 Claims, 10 Drawing Sheets

ANCHORING WEDGE WITH SEPARABLE BOLT AND METHOD OF ANCHORING TENDON USING THE SAME

CROSS-REFERENCE

This application claims priority to and the benefit of Korean Patent Application No. 2017-0133805, filed on Oct. 16, 2017, the disclosure of which is incorporated herein by reference in its entirety.

BACKGROUND

1. Field of the Invention

The present invention relates to an anchoring wedge with a separable bolt and a method of anchoring a tendon using the same, and more particularly, to an anchoring wedge with a separable bolt, capable of simply separating the anchoring wedge anchored to an anchoring device while surrounding the tendon, from the anchoring device using the separable bolt to efficiently adjust a tensile force, and a method of anchoring a tendon using the same.

2. Discussion of Related Art

FIG. 1A to FIG. 1D illustrate a general wedge separation device 5 anchored on a tendon.

As shown in FIG. 1A to FIG. 1D, the wedge separation device 5 disassembles a wedge 4 coupled to a prestressing tendon 3 from a barrel anchoring device 2 and includes a wedge insertion portion 52 where the wedge 4 is inserted into and held by and which is depressed in a front end of a barrel-shaped body 51, a tendon insertion hole 53 through which the prestressing tendon 3 passes and which is formed in a center of the wedge insertion portion 52 while penetrating a rear of the body 51, an anchoring device insertion portion 55 which has a diameter greater than that of the wedge insertion portion 52 and is formed in front of the wedge insertion portion 52 in a center of a front end of the body 51 and where the barrel anchoring device 2 to which the prestressing tendon 3 is anchored is inserted into and held by, and an opening portion 54 formed at a side surface of the wedge insertion portion 52 of the body 51 to collect the wedge 4.

That is, it may be seen that the wedge separation device 5 is installed to come into close contact with a surface of a concrete structure 1 and the wedge 4 is separated from the barrel anchoring device 2 by stretching the prestressing tendon 3 rearward (FIG. 1B) such that the wedge 4 may be separately discharged through the opening portion 54.

However, in the wedge separation device 5, since it is necessary to stretch the anchored prestressing tendon 3 rearward and the rearward stretching operation suddenly releases the tensile force applied to the prestressing tendon 3, a safety problem may occur at a structure in which the prestressing tendon 3 is built.

Also, since it is not easy to provide work space when the prestressing tendon 3 is stretched rearward, a stretching device is inefficiently managed and a bouncing phenomenon of the prestressing tendon 3 may occur due to an excessive tensile force while the prestressing tendon 3 is stretched, such that there may be limitation in actual use.

FIG. 1E illustrates an installation state of a bolt anchoring device filed by the present applicant, which uses a method of improving lateral strength and fire resistance capacity of a column into which uniform prestressing may be introduced.

The bolt anchoring device includes an anchoring nut 41 which fastens and fixes, to the module board 10, an anchoring bolt 40 inserted in an anchoring hole 11 formed at a module board 10; the anchoring bolt 40 which includes a bolt portion with a screw portion 42 formed on an outer circumferential surface thereof to be inserted into and fastened to the anchoring hole 11 and includes a head portion with a wedge groove 42*a* to allow a wedge 45 to be inserted and anchored therein; a deformation clip 43 which includes an annular ring portion 43*a* which allows a wire rope 30 to pass therethrough and has an annular shape to allow the wedge 45 to be deformed while being inserted and anchored through prestressing and includes a pair of flange portions 43*b* extending horizontally from both sides of the annular ring portion 43*a*; a clip nut 44 which has a diameter greater than that of the bolt portion of the anchoring bolt 40 and includes a clip groove 44*a* in which the deformation clip 43 is accommodated at a portion in contact with the bolt portion and which includes a through hole 44*b* at a central portion thereof to allow the wedge 45 to pass therethrough, and the wedge 45 which allows the wire rope 30 to be stretched and anchored through the through hole 44*b* of the clip nut 44, the annular ring portion 43*a* of the deformation clip 43, and the wedge groove 42*a* of the bolt portion of the anchoring bolt 40. Here, the deformation of the clip nut 44 may be used to check on an initial prestressing amount introduced by the anchoring of the wedge 45.

Here, it may be seen that the wedges 4 and 45 for anchoring use a plurality of fragments mutually restrained to surround the tendon and are generally inserted into and compressed by the anchoring hole formed to be tapered at the anchoring device in order to anchor the tendon including the wire rope to the anchoring device such that the wedges 4 and 45 may be separated from the anchoring device when the anchored state is released.

However, when manmade pulling operation is needed as shown in FIG. 1A to FIG. 1D, it may be seen that it is difficult to use in the field and there is room for improvement since not only safety of the structure, in which the anchoring device is installed, is not secured but also work spaces for the pulling operation and stretching equipment are required.

SUMMARY OF THE INVENTION

According to one aspect of the present invention, an anchoring wedge with a separable bolt includes an anchoring device which includes an internal groove formed to communicate with an anchoring hole in which the anchoring wedge is anchored, the anchoring wedge which is anchored in the anchoring hole of the anchoring device and includes a bolt hole which is a horizontal hole extended to pass through a top surface and an inside and be exposed to an outside and a fastening portion formed in a middle of the bolt hole; and a separable bolt including a bolt body portion which is a bar member on which a fastening device, which engages in screw-movement while engaged with the fastening portion of the anchoring wedge and rotating, is formed in a middle and is formed to allow a part, inserted in the bolt hole formed at the anchoring wedge and at which a front end portion is formed, to be exposed to an anchoring groove. Here, the anchoring wedge is separable from the anchoring hole by rotating of the separable bolt inserted and installed in the anchoring wedge.

According to another aspect of the present invention, a method of anchoring a tendon using an anchoring wedge with a separable bolt includes (a) preparing an anchoring device which includes an internal groove formed to communicate with an anchoring hole in which the anchoring wedge is anchored, (b) preparing the anchoring wedge which is anchored in the anchoring hole of the anchoring device and includes a bolt hole which is a horizontal hole extended to pass through a top surface and an inside and be exposed to an outside and a fastening portion formed in a middle of the bolt hole, and (c) inserting a separable bolt including a bolt body portion which is a bar member and is formed to allow a part, inserted in the bolt hole formed at the anchoring wedge and at which a front end portion is formed, to be exposed to an anchoring groove while allowing a fastening device to engage in screw-movement while engaged with the fastening portion of the anchoring wedge and rotating. Here, the anchoring wedge is allowed to surround the tendon to be anchored in the anchoring hole of the anchoring device.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1A:
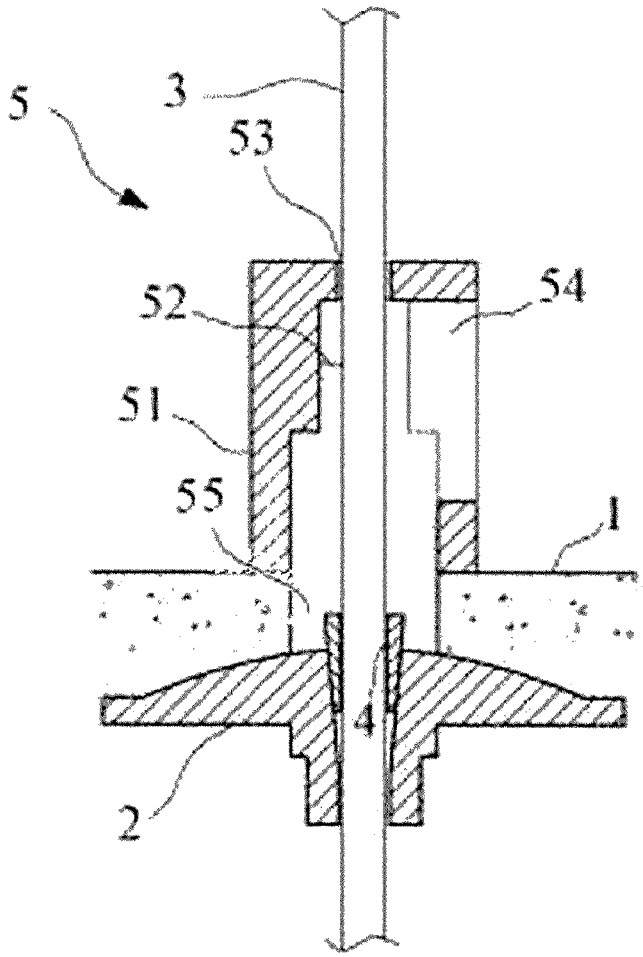
FIG. 1A (RELATED ART)
FIG. 1A to FIG. 1E are configuration diagrams of a general wedge separation device anchored to a tendon and a general bolt anchoring device.
Figure 1B:
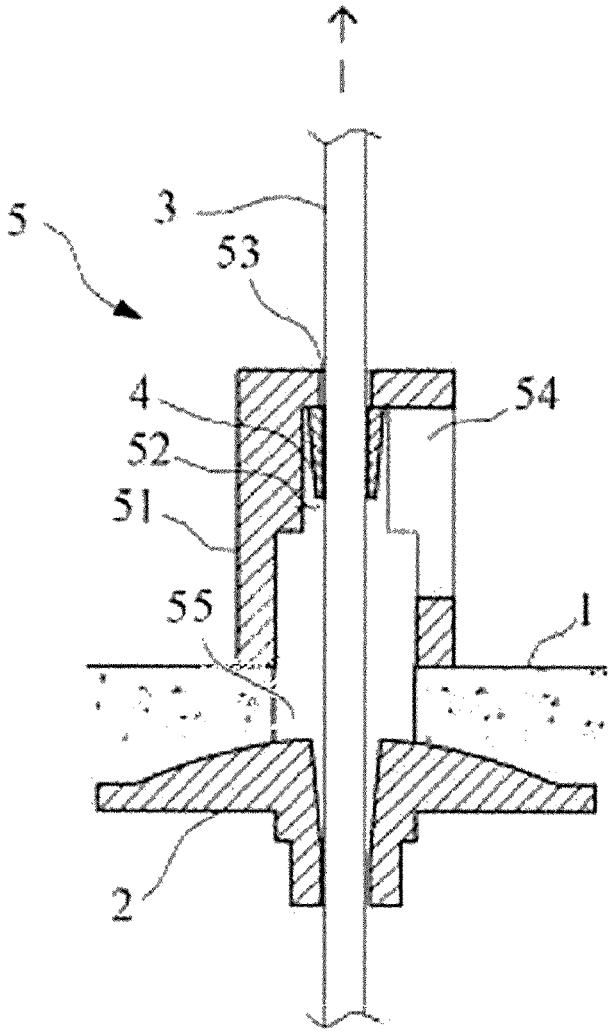
FIG. 1B(RELATED ART)
Figure 1C:
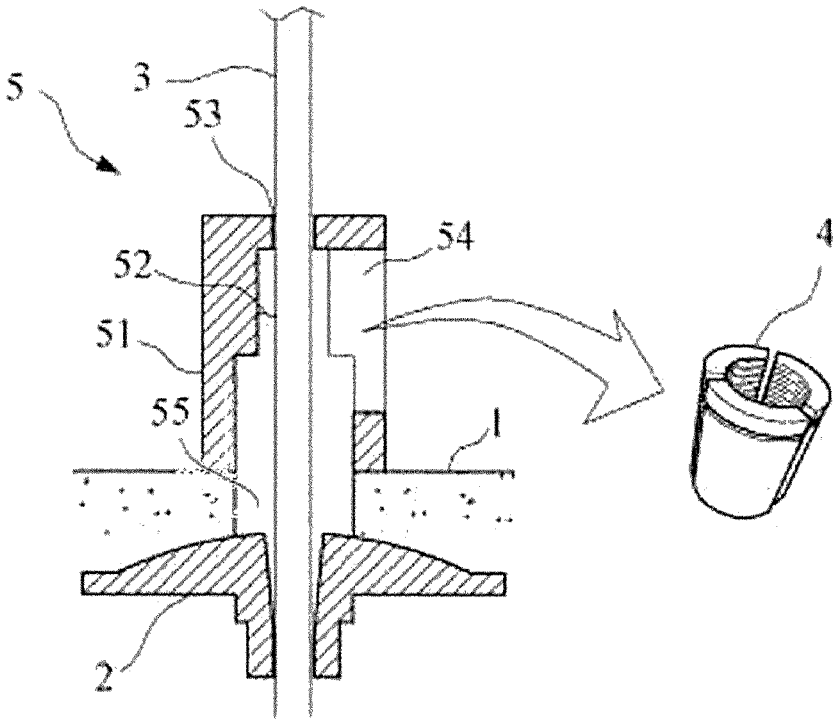
FIG. 1C (RELATED ART)
Figure 1D:
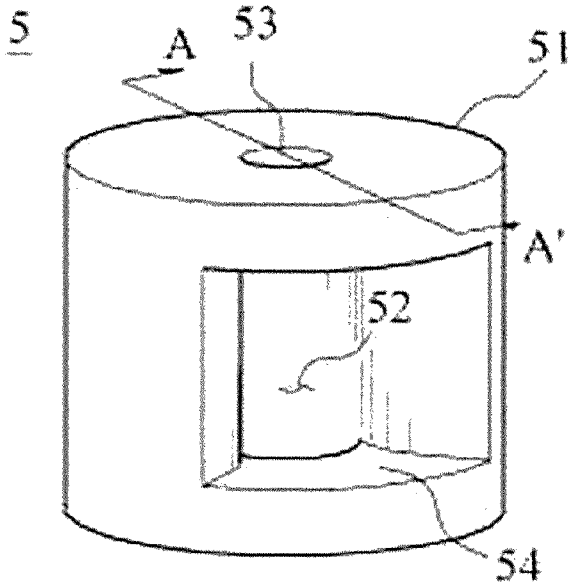
FIG. 1D (RELATED ART)
Figure 1E:
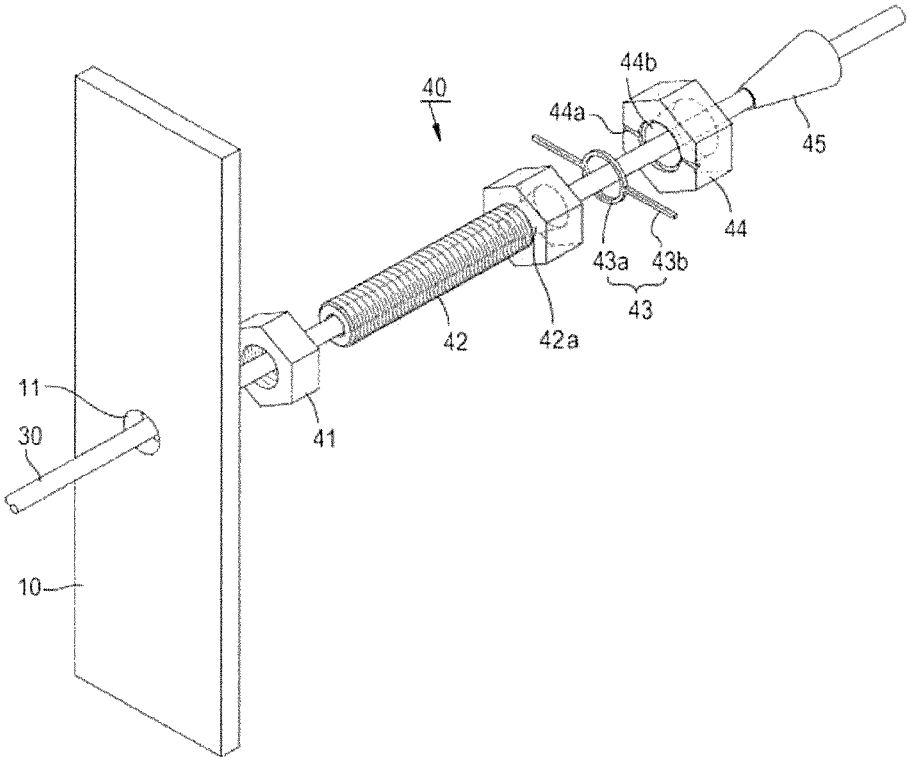
FIG. 1E (RELATED ART)

Hereinafter, embodiments of the present invention will be described in detail with reference to the attached drawings to allow one of ordinary skill in the art to easily execute the same. However, the present invention may be embodied in a variety of forms and is not limited to the embodiments described herein. Also, throughout the drawings, a part irrelevant to a description of the present invention will be omitted to clearly explain the present invention. Throughout the specification, like reference numerals refer to like portions.

Throughout the specification, when it is stated that a part "includes" an element, unless particularly defined otherwise, it means that the part does not exclude other elements and may further include other elements.

[Anchoring Wedge 100 Including Separable Bolt According to the Present Invention]

Figure 2:
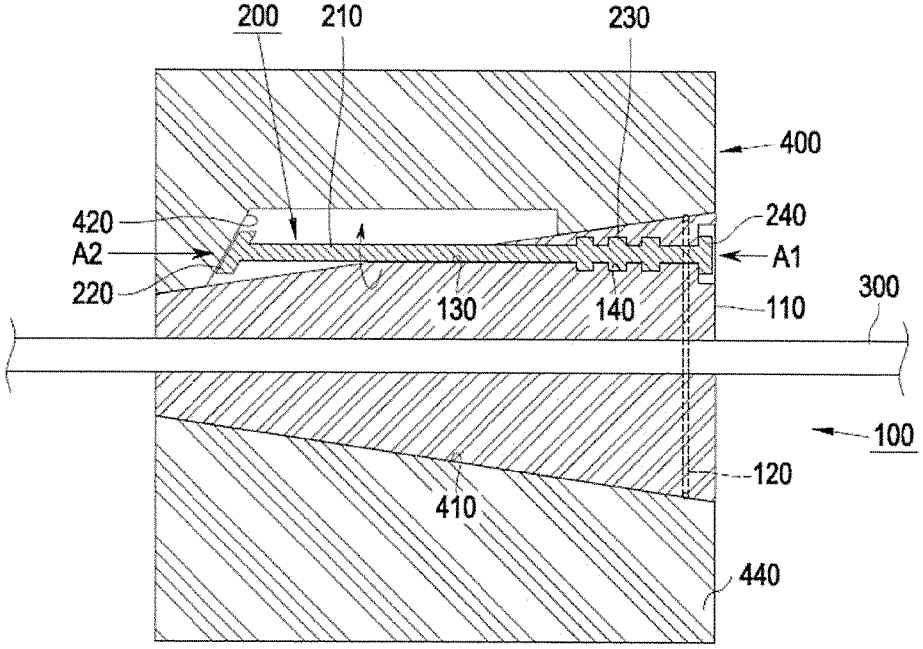
FIG. 2 is a perspective configuration diagram of an anchoring wedge with a separable bolt according to one embodiment of the present invention.

FIG. 2 illustrates an installation view of an anchoring wedge 100 with a separable bolt 200 according to one embodiment of the present invention.

The anchoring wedge 100, as shown in FIG. 2, is inserted into and anchored in an anchoring hole 410 processed to be tapered so as to penetrate a head portion 440 of an anchoring device 400 and is formed to allow a plurality of wedge fragments 110 which surrounds a tendon 300 to be restrained by a binding ring 120 inserted in a groove formed at an end of the anchoring hole 410.

The wedge fragments 110 are generally manufactured using steel fragments, are formed in a shape with a width which gradually increases from a bottom end (a left side of FIG. 2) toward a top end (a right side of FIG. 2) and which corresponds to the tapered anchoring hole 410, and are installed to surround the top end using the binding ring 120 to maintain an inscribed state of the tendon 300 while allowing the plurality of wedge fragments 110 to come into contact with each other at side surfaces thereof.

However, the anchoring wedge 100 is not limited to using the wedge fragments 110, and any wedge may be used which is capable of forming a bolt hole 130, which will be described below, and of anchoring the tendon 300 in the anchoring hole 410. In the present embodiment, the anchoring wedge 100 will be described on the basis of the wedge fragments 110.

In addition, it may be seen that the bolt hole 130 is formed at the anchoring wedge 100, and a case in which the bolt hole 130 is formed at the wedge fragments 110 will be described in the present invention.

The bolt hole 130 is formed as, for example, a horizontal hole extended to pass from a top surface A1 of the wedge fragments 110 through an inside and be exposed to an outside, and it may be seen that a fastening portion 140, which is a kind of screw groove, is formed in a middle thereof.

The fastening portion 140 allows the separable bolt 200, which will be described below, to be rotatably fastened to the bolt hole 130 and prevents the separable bolt 200 from being separated from the bolt hole 130. Hereby, the fastening portion 140 may be a female screw portion.

Also, a top end of the bolt hole 130 is extended to accommodate a rotatable nut 240 which forms the separable bolt 200 which will be described below.

The anchoring device 400 includes the tapered anchoring hole 410 as a member in which the anchoring wedge 100 is anchored, and the anchoring wedge 100 formed to surround the tendon 300 is inserted and anchored in the anchoring hole 410.

The anchoring device 400, as shown in FIG. 2, may further include an internal groove 420 connected to communicate with the anchoring hole 410.

Hereby, it may be seen that the bolt hole 130 formed at the wedge fragments 110 is extended toward the internal groove 420 such that a front end portion 220 of the separable bolt 200 inserted in the bolt hole 130 may be exposed to the internal groove 420.

That is, the internal groove 420 has a groove shape which is concave with respect to an inner surface of the anchoring hole 410 and extends in a longitudinal direction of the anchoring device 400 such that as the separable bolt 200 is rotated while the front end portion 220 of the separable bolt 200 comes in contact with an inclined inner surface A2 of the internal groove 420 to be supported, a fastening device 230 of the separable bolt 200 screw-coupled to the fastening portion 140 engages in screw-movement (in the case of FIG. 2, toward a right side) and separates the wedge fragments 110 from the anchoring hole 410.

Figure 3A:
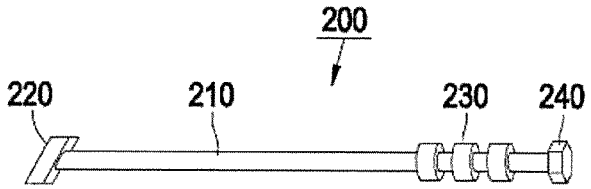
FIG. 3A, FIG. 3B, and FIG. 3C are operational views of the anchoring wedge with the separable bolt according to one embodiment of the present invention.
Figure 3B:
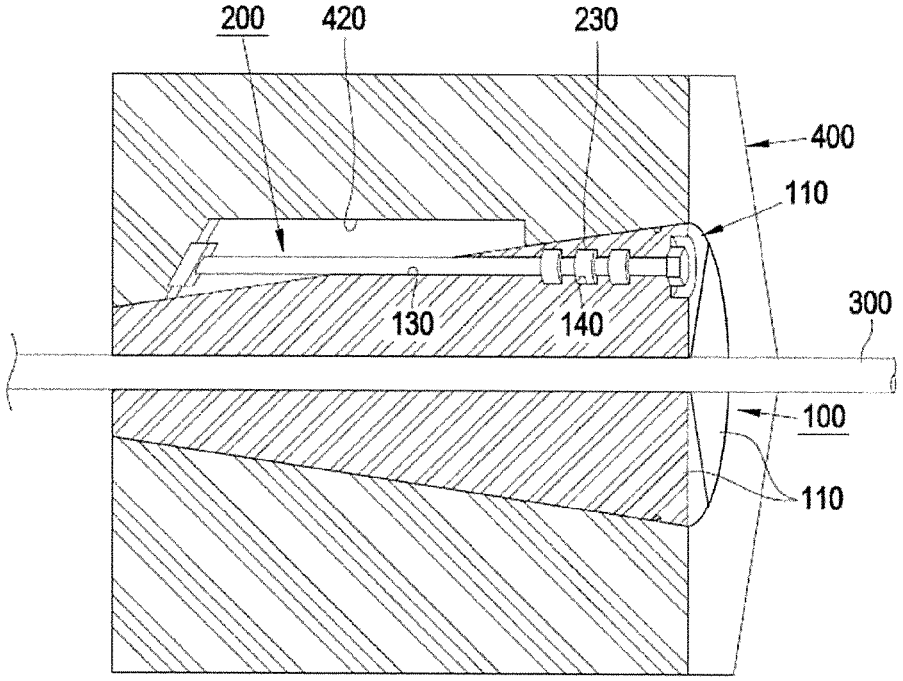
Figure 3C:
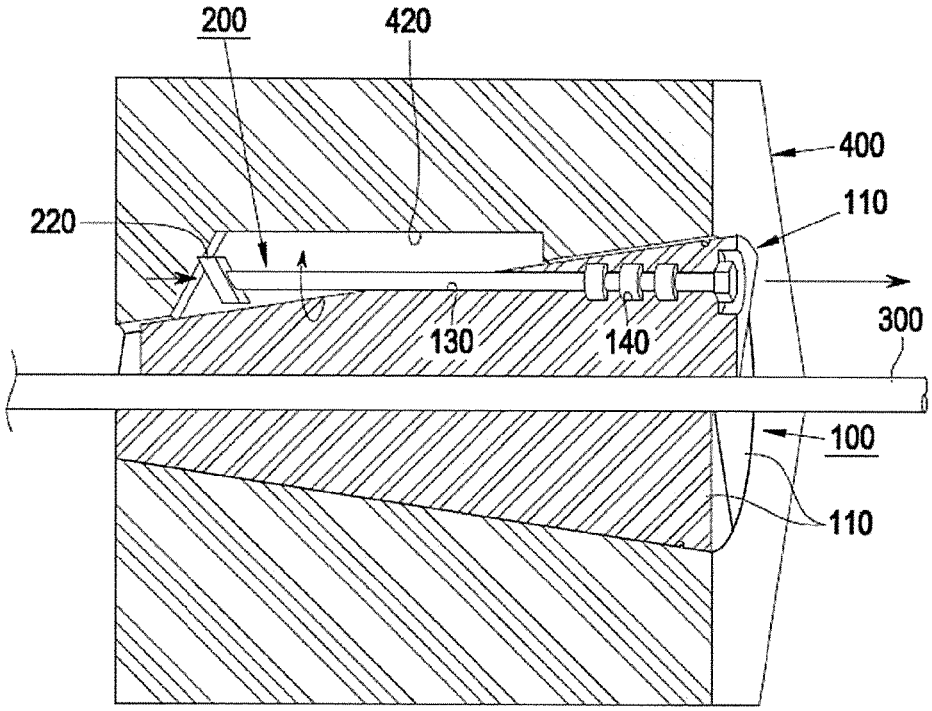

The separable bolt 200, as shown in FIG. 2 and FIG. 3C, is a bar member which, as a bar-shaped member, separates the anchoring wedge 100 from the anchoring device 400 and includes a bolt body portion 210, the front end portion 220, the fastening device 230, and the rotatable nut 240.

The bolt body portion 210, as shown in FIG. 2, FIG. 3A and FIG. 3B, is a bar member which has a diameter inserted into the bolt hole 130 formed at the wedge fragments 110 which form the anchoring wedge 100, and a part at which the front end portion 220 is formed is to be exposed to the internal groove 420.

Next, the front end portion 220, as shown in FIG. 2 and FIG. 3C, may be formed at a front end of one side of the bolt body portion 210 and be assembled to be an extended flange while a contact area between the inclined inner surface of the internal groove 420 and a front end surface is increased to support rotational movement of the separable bolt 200.

Next, the fastening device 230, as shown in FIG. 2 and FIG. 3C, is formed to be, for example, a male screw portion fastened to the fastening portion 140 formed at the wedge fragments 110 so as to be engaged with the fastening portion 140 which is a female screw portion and to rotate such that screw movement separating the anchoring wedge 100 from the anchoring hole 410 may be performed. Here, since it is necessary only to release an anchored state of the tendon 300, an excessive force is unnecessary.

Next, the rotatable nut 240, as shown in FIG. 2 and FIG. 3C, is formed through integral assembly at a head of the bolt body portion 210 so as to fix the head of the bolt body portion 210 to the wedge fragments 110 at the top end of the extended bolt hole 130 formed at the wedge fragments 110. Also, rotation of the separable bolt 200 has a rotational force by allowing a rotator (not shown) to rotate the rotatable nut 240. Also, the rotatable nut 240 is to be accommodated in a block-out groove at the end A1 of the wedge fragments 110.

The tendon 300, as shown in FIG. 2 and FIG. 3C, may be a PC wire, a wire rope, and the like, is anchored in a state in which tensile force is introduced due to a region being surrounded by the anchoring wedge 100 and anchored to the anchoring device 400, and introduces prestressing into an anchorage portion 500 (see FIG. 4A and FIG. 4B) at which the tendon 300 is installed by anchoring.

[Operation of Anchoring Wedge 100 Including Separable Bolt According to the Present Invention]

FIG. 3A, FIG. 3B and FIG. 3C are operational views of the anchoring wedge 100 with the separable bolt according to one embodiment of the present invention.

First, an operation will be described below in which the separable bolt 200 separates the anchoring wedge 100 anchored to the anchoring device 400 as the fastening device 230 of the separable bolt 200 is rotatably fastened, using a female screw and a male screw, to the fastening portion 140 formed at the anchoring wedge 100.

First, as shown in FIG. 3A to FIG. 3B, it may be seen that the tendon 300 is anchored in the anchoring hole 410 of the anchoring device 400 by the anchoring wedge 100.

Here, since the fastening device 230 of the separable bolt 200 is inserted and installed to be rotatably fastened to the fastening portion 140 of the bolt hole 130 formed at the wedge fragments 110 of the anchoring wedge 100, the bolt body portion 210 is inserted and extended in the bolt hole 130.

Hereby, the front end portion 220 in an inclined flange shape is formed at a front end of the separable bolt 200, and the front end portion 220 is set while in contact with the inner surface of the internal groove 420.

Also, it may be seen that the rotatable nut 240 is fastened as a whole to an extended top surface of the bolt hole 130, formed at the wedge fragments 110 of the anchoring wedge 100, on the head of the separable bolt 200. Hereby, when the rotatable nut 240 is rotated, the separable bolt 200 rotates. As the fastening device 230 fastened to the fastening portion 140 rotates, the separable bolt 200 may cause the bolt hole 130 to engage in screw-movement.

Accordingly, as shown in FIG. 3C, when the separable bolt 200 is counter-rotated while the front end portion 220 of the separable bolt 200 is in contact with the internal groove 420 of the anchoring device 400, the front end portion 220 is spaced apart from the internal groove 420 and the fastening device 230 engages in screw-movement along the fastening portion 140 such that the anchoring wedge 100 is simply separated from the anchoring hole 410 of the anchoring device 400.

Hereby, when a worker has the rotator capable of rotating the rotatable nut 240, an additional tendon stretching space is not necessary to prepare and accordingly a bounce phenomenon of the tendon may be prevented.

Particularly, when a wire rope is used, since it is possible to separate the tendon from the anchoring device as necessary, a tensile force introduction speed and efficiency of a changing operation may be maximized.

[Method of Anchoring Tendon Using Anchoring Wedge Including Separable Bolt According to the Present Invention]

Figure 4A:
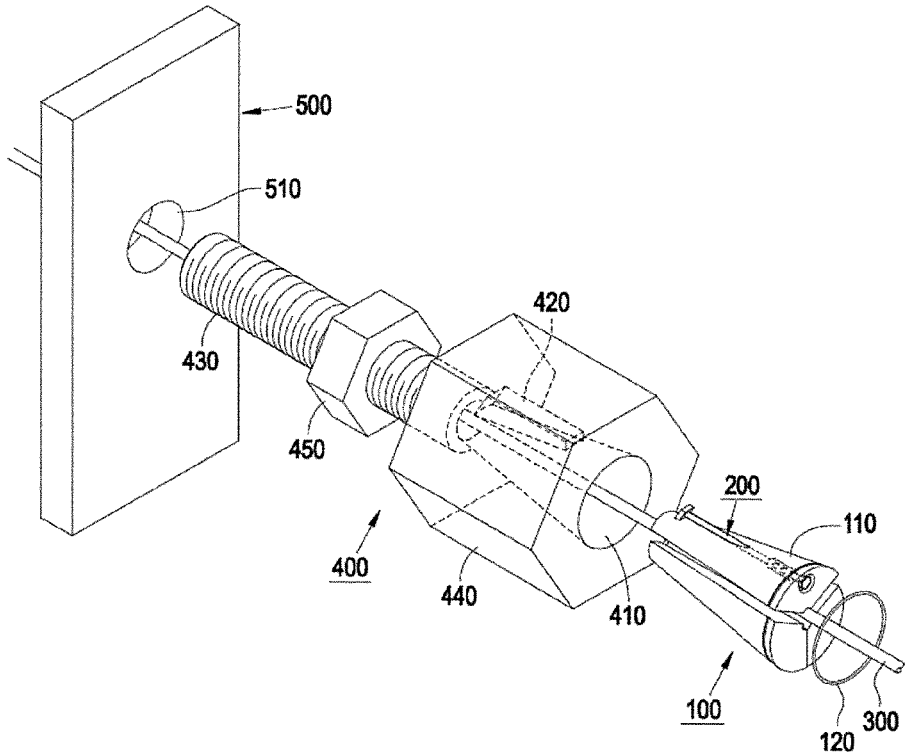
FIG. 4A and FIG. 4B are perspective configuration diagrams illustrating a method of anchoring a tendon using the anchoring wedge with the separable bolt according to one embodiment of the present invention.
Figure 4B:
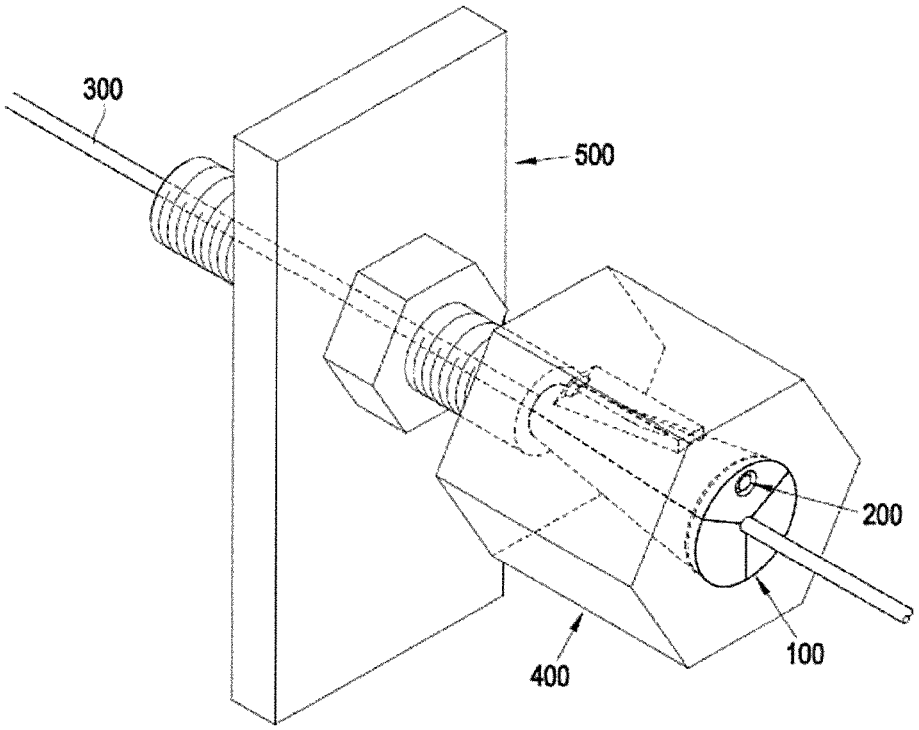

FIG. 4A and FIG. 4B are perspective configuration diagrams illustrating a method of anchoring the tendon using the anchoring wedge with the separable bolt according to one embodiment of the present invention.

First, the anchoring wedge 100 with the separable bolt 200 is to be installed to anchor the tendon 300 to the anchoring device 400, and the anchoring device 400 includes a hexagonal head portion 440 and bolt portion 430 formed as a whole.

Also, a fixing nut 450 is formed to fasten and fix, to the anchorage portion 500, the bolt portion 430 of the anchoring device 400 inserted in a through hole 510 formed at the anchorage portion 500.

Hereby, as shown in FIG. 4A, first, the anchoring device 400 including the bolt portion 430 is prepared, and the head portion 440 of the anchoring device 400 includes the anchoring hole 410 formed in a tapered shape so as to pass through a center thereof. Also, as shown in FIG. 2, the anchoring hole 410 communicates with the internal groove 420.

Also, the anchoring hole 410 is continuously extended toward the internal groove 420 to the bolt portion 430 formed to be integrated with the hexagonal head portion 440.

The tendon 300 is allowed to pass through the anchoring device 400 including the bolt portion 430 while the anchoring wedge 100 with the separable bolt 200 is initially anchored to the tendon 300.

That is, the anchoring wedge 100 is set to allow the plurality of wedge fragments 110 to be restrained by the binding ring and to surround the tendon 300. Also, the separable bolt 200 is inserted in the bolt hole 130 of the wedge fragments 110, the fastening device 230 of the separable bolt 200 is fastened to the fastening portion 140, and the rotatable nut 240 is accommodated in the extended top surface of the wedge fragments 110.

Hereby, as shown in FIG. 4B, the anchoring device 400 including the bolt portion 430 is inserted into the through hole 510 formed at the anchorage portion 500, and the bolt portion 430 is fixedly installed on one surface of the anchorage portion 500 by using the fixing nut 450.

Next, the tendon 300 is stretched by a wire rope and the anchoring wedge 100 with the separable bolt 200 is inserted into the anchoring hole 410 of the anchoring device 400 while the front end portion 220 of the separable bolt 200 is set inside the internal groove 420 of the anchoring device 400.

Hereby, when the tensile force introduced into the tendon 300 is released, the separable bolt 200 is anchored to the anchoring device 400 through a reaction.

Here, when it is necessary to separate the anchoring wedge 100 from the anchoring device 400, as shown in FIG. 3A to FIG. 3C, a front end portion of the separable bolt 200 comes into contact with an inclined inner surface of the internal groove 420 due to rotation of the rotatable nut 240 formed on the head of the separable bolt 200 to be supported. In this state, when the separable bolt 200 is additionally rotated, rotational movement is restrained such that the anchoring wedge 100 may be moved and separated from the anchoring hole 410 of the anchoring device 400.

According to the embodiments of the present invention, an anchoring wedge and a method of anchoring a tendon using the same make it possible to separate the anchoring wedge from an anchoring device by only installing a separable bolt at the anchoring wedge and rotating the separable bolt, making use of the anchoring wedge more quick and efficient.

Hereby, since it is possible to precisely control prestressing introduced to a structure by partially adjusting a tensile force of a tendon, a structural member may be effectively managed.

Also, in general, in order to introduce prestressing by using a tendon and to disassemble an anchoring device, it is necessary to install a complicated apparatus or to use an auxiliary disassembling device. However, the configuration of the present invention makes it possible to pull a wedge by applying a separable bolt and using a rotational force of a simple device (rotational tool), and durability may be provided by such a simple configuration.

Also, according to the embodiments of the present invention, excessive prestressing introduced by a tendon facilitates re-tensing after disassembly. Since releasing tension is an integral operation in the absence of the application of post-tension, here, it is possible to apply post-tension without any effects on an anchored structural member through a particularly simple and safe release.

The above description of the present invention is for example, and it will be understood that the embodiments of the present invention may be easily modified by one of ordinary skill in the art without changing of the technical features or essential properties of the present invention. Therefore, the above-described embodiments should be understood to be exemplary and not to be limitative in every aspect. For example, elements described as a single form may be executed while being distributed, and similarly, elements described as being distributed may be executed as being combined.

The scope of the present disclosure will be defined by the following claims rather than the above detailed description, and all changes and modifications derived from the meaning and the scope of the claims and equivalents thereof should be understood as being included in the scope of the present invention.

What is claimed is:

1. An anchoring wedge device with a separable bolt, comprising:

an anchoring device, comprising an internal groove formed to communicate with an anchoring hole;

an anchoring wedge, anchored in the anchoring hole of the anchoring device and comprising a bolt hole, wherein the bolt hole is a horizontal hole extended to pass through a top surface and an inside of the anchoring wedge and to be exposed to an outside of the anchoring wedge, and the bolt hole comprises a fastening portion formed in a middle of the bolt hole; and the separable bolt, comprising a bolt body portion, wherein the bolt body portion is a bar member on which a fastening device formed in a middle thereof, wherein a part of the bolt body portion inserted in the bolt hole formed at the anchoring wedge and at which a front end portion is exposed to the internal groove, and wherein the fastening device is engaged with the fastening portion of the anchoring wedge and rotating through a screw-movement, wherein the anchoring wedge is anchored in the anchoring hole by disposing a tendon to pass through the anchoring hole, and the anchoring wedge is separable from the anchoring hole by rotating of the separable bolt inserted and installed in the anchoring wedge.

2. The anchoring wedge device of claim 1, wherein the anchoring device further comprises:

a head portion, wherein the anchoring hole is tapered and passes therethrough;

a bolt portion, formed to be integrated with the head portion; and a fixing nut, fastening and fixing the bolt portion to the anchorage portion, wherein the tendon is further disposed to pass through the bolt portion, such that the anchoring wedge is anchored in the anchoring hole.

3. The anchoring wedge device of claim 1, further comprising a plurality of wedge fragments arranged to surround to a tendon and allowing the bolt hole to be formed as the horizontal hole in the plurality of wedge fragments, wherein the separable bolt is inserted into the bolt hole formed in the plurality of wedge fragments, and the front end portion is exposed to the internal groove.

4. The anchoring wedge device of claim 3, wherein the bolt body portion is a bar member inserted into the bolt hole formed at the anchoring wedge and formed to expose a part, at which the front end portion is formed, to the internal groove;

the front end portion is formed to be assembled with a front end of one side of the bolt body portion to form an extended flange and supports a rotational movement of the separable bolt by increasing a contact area between an inclined inner surface of the internal groove and a front end surface of the front end portion; and the fastening device rotates while engaged with the fastening portion of the anchoring wedge through a screw-movement to separate the anchoring wedge from the anchoring hole.

5. The anchoring wedge device of claim 4, wherein the separable bolt allows the rotatable nut fixing a head of the bolt body portion to the anchoring wedge to be assembled with the head of the bolt body portion as a whole, and the rotatable nut is accommodated in a block-out groove at a top end of the plurality of wedge fragments.

6. The anchoring wedge device of claim 1, wherein the anchoring wedge anchors a tendon by stretching to the anchoring hole, and the tendon comprises a wire rope.

7. A method of anchoring a tendon using an anchoring wedge with a separable bolt, the method comprising:

(a) preparing an anchoring device comprising an internal groove formed to communicate with an anchoring hole that the anchoring wedge being anchored;

(b) preparing the anchoring wedge being anchored in the anchoring hole of the anchoring device and comprising a bolt hole and a fastening portion formed in a middle of the bolt hole, wherein the bolt hole is a horizontal hole extended to pass through a top surface and an inside of the anchoring wedge and to be exposed to an outside of the anchoring wedge; and (c) inserting a separable bolt comprising a bolt body portion and a fastening device, wherein the bolt body portion is a bar member and a part thereof inserted in the bolt hole formed at the anchoring wedge and at which a front end portion is allowed to be exposed to the internal groove while a fastening device is allowed to be engaged with the fastening portion of the anchoring wedge and rotating through a screw-movement, wherein the anchoring wedge is allowed to surround the tendon to be anchored in the anchoring hole of the anchoring device.

8. The method of claim 7, wherein the anchoring device of the operation (a) comprises:

a head portion formed to allow the anchoring hole to pass therethrough, wherein the anchoring hole is tapered;

a bolt portion formed to be integrated with the head portion; and a fixing nut fastening and fixing the bolt portion to the anchorage portion.

9. The method of claim 8, wherein for the separable bolt of the operation (c), the bolt body portion is a bar member inserted into the bolt hole formed at the anchoring wedge and formed to expose a part, at which the front end portion is formed, to the internal groove;

the front end portion is formed to be assembled with a front end of one side of the bolt body portion to form an extended flange and supports a rotational movement of the separable bolt by increasing a contact area between an inclined inner surface of the internal groove and a front end surface of the front end portion;

the fastening device rotates while engaged with the fastening portion of the anchoring wedge through a screw-movement to separate the anchoring wedge from the anchoring hole;

wherein the separable bolt further comprises a rotatable nut fixing a head of the bolt body portion to the anchoring wedge and assembled to be integrated with the head of the bolt body portion to allow the head portion to be accommodated in a block-out groove at a top end of the anchoring wedge.

10. The method of claim 7, wherein the anchoring wedge of the operation (b) further comprises a plurality of wedge fragments arranged to surround the tendon and allows the bolt hole to be formed as a horizontal hole in the plurality of wedge fragments, such that the separable bolt is inserted into the bolt hole formed in the plurality of wedge fragments, and the front end portion is exposed to the internal groove, wherein the anchoring wedge anchors the tendon by stretching in the anchoring hole while the tendon comprises a wire rope.

* * * * *